US005338342A

United States Patent [19]

Mallory, Jr.

[11] Patent Number: 5,338,342

[45] Date of Patent: Aug. 16, 1994

[54] STABILIZED ELECTROLESS NICKEL PLATING BATHS

[76] Inventor: Glen O. Mallory, Jr., c/o Electroless Technologies Corp. 3860 Cloverdale, Los Angeles, Calif. 90008

[21] Appl. No.: 65,870

[22] Filed: May 21, 1993

[51] Int. Cl.[5] ..... C23C 18/36

[52] U.S. Cl. ..... 106/1.22; 106/1.27

[58] Field of Search ..... 106/1.22, 1.27

[56] References Cited

U.S. PATENT DOCUMENTS 3,650,803 3/1972 Lin ..... 106/1.27

3,946,126 3/1976 Feldstein ..... 106/1.27

*Primary Examiner*—Helene Klemanski

[57] ABSTRACT

Stabilized electroless nickel plating baths employing a hypophosphite reducing agent and conducted under electroless plating conditions which are treated to remove and control phosphite anions by the addition of lithium hydroxide to form insoluble dilithium phosphite readily recoverable from the bath on a batch or continuous basis.

20 Claims, No Drawings

STABILIZED ELECTROLESS NICKEL PLATING BATHS

This invention relates to stabilized electroless nickel plating baths which employ a hypophosphite reducing agent. More particularly this invention relates to a process for achieving improved, long running electroless nickel plating baths through control and removal of undesirable phosphite anions produced as a by-product during the electroless plating reaction while simultaneously minimizing the presence and effect of undesirable alkali metal cations such as sodium, potassium and ammonium cations.

Electroless nickel plating is a unique and a widely utilized plating process which provides a continuous deposit of a nickel metal coating on metallic or non metallic substrates without the need for an external electric plating current. Such process is described generally as a controlled autocatalytic chemical reduction process for depositing the desired nickel metal and is simply achieved by immersion of the desired substrate into an aqueous plating solution under appropriate electroless plating conditions.

In conducting electroless nickel plating, particularly which utilizes a hypophosphite as the reducing agent, the bath employed basically contains a source of nickel cations such as a nickel sulfate and a hypophosphite reducing agent such as sodium hypophosphite. The deposition reaction takes place in the bath and generally involves the reduction of a nickel cation to form a nickel metal alloy as a deposit on the desired substrate surface. The reduction reaction is generally represented by the following equation:

$$3H_2PO_2^- + Ni^{2+} \rightarrow Ni^{\circ} + \tfrac{1}{2}H_2\uparrow + H^+ + 2H\text{-}PO_3^{2-} + P$$

The electroless reaction also produces phosphite ions, hydrogen ions, hydrogen gas and an anion of the nickel source compound used, typically a sulfate [$SO_4^{2-}$]. The nickel and hypophosphite are consumed in the reaction and they, accordingly, must be frequently replenished. In addition, the hydrogen ions produced in the reaction accumulate with a resultant lowering of the pH from the optimum plating ranges. In order to maintain the desired pH range, and in usual practice, a pH adjustor such as a hydroxide or carbonate especially of an alkali metal such as sodium is added frequently during the plating reaction. This increases the maintenance of undesired alkali cations such as sodium and significantly increases the monovalent sodium cation concentration.

Additionally, nickel usually in the form of nickel sulfate is added to maintain the optimum nickel concentration thereby increasing the concentration of undesirable sulfate anion in the form of sodium sulfate. As the reaction continues the by-products and bath conditions created present problems which adversely affect the desired plating process. Foremost of these problems are the buildup of the phosphite anion produced from the oxidation of the hypophosphite reducing agent and the anion of the nickel salt employed, typically a sulfate, as well as the increased concentration of extraneous sodium cations. This build-up or increase in the concentration of such anions and cations as they accumulate in the bath present a deleterious effect on the plating reaction and also adversely affects the quality of the plating substrate. In particular the phosphite anions adversely affect the plated deposit reaction often reacting with and precipitating the nickel cation as nickel phosphite with result that the rate of deposition of nickel slows and prevents long lasting stabilized baths. This results in the bath being terminated at low levels of metal turnover, that is the number of times that the original nickel source is replenished. Further these by-products additionally present environmental problems which inhibit an appropriate disposal of spent baths, but more particularly such phosphite as well as added alkaline metal cations and sulfates particularly prevent the ready and economical re-use of the expensive plating solutions.

These deleterious factors and particularly the build-up of phosphite and sulfate anions have been addressed through use of a variety of treatment methods. These treatment are illustrated in the prior art in such references as G. G Gawrilov, Chemical Nickel Plating, Portcullis Press, England, 1974; Wei-chi Ying and Robert R. Bonk, Metal Finishing, 85, 23–31, (Dec. 1987); E. W. Anderson and W. A. Neff, Plating and Surface Finishing, 79, 18–26, (March 1992); and K. Parker, Plating and Surface Finishing, 67, 48–52, (March 1980).

Typically these prior art methods have involved the treatment of the plating bath solution, usually after plating and prior to final bath disposal, with calcium or magnesium salts, ferric chloride and weak based anionic exchange resins. Such methods, however, have not been effective and particularly in rejuvenating spent baths during plating for a variety of reasons. The use, for example, of calcium or magnesium salts introduces calcium and magnesium ions into the bath which are deleterious to the plating reaction. Ferric chloride addition results in a lowering of the desired pH range for the bath and introduces iron into the bath, while ion exchange treatments removes the hypophosphite anion required for the plating reaction together with the unwanted phosphite anions from the plating reaction bath.

It has now been discovered, however, that the by-product phosphite anions may be readily removed from the plating bath solution using a relatively simple process without the disadvantages of the prior methods and while achieving a stabilized bath free of added cations, such as sodium, frequently introduced through the hypophosphite reducing agent or pH plating controls. This discovery allows long running, stabilized nickel bath operations with maintained high plating rates.

These results are basically achieved in accordance with the stabilizing process of the present invention by adding lithium hydroxide to the plating bath to form dilithium phosphite which under appropriate insolubility conditions allows the formation of insoluble dilithium phosphite which in such form is capable of being then readily removed from the plating bath. Such process is further enhanced though the combined use of lithium hypophosphite as the hypophosphite reducing agent. This favors the desired formation of the removable dilithium phosphite, and additionally serves to avoid the addition of sodium and other monovalent alkali metal cations, for example, in the form of the conventional sodium hypophosphite reducing agent. This process thus allows the ready removal of the undesired phosphite which builds up in the bath as a result of the electroless reduction and thereby achieves a stabilized bath with a continued high rate of plating even after multiple turnovers of the original nickel source. The formation reaction of the dilithium phosphite is generally represented as follows:

$$LiOH.H_2O + LiH_2PO_3 \rightarrow Li_2HPO_3 + 2H_2O$$

Accordingly an object of the invention is to provide stabilized electroless nickel plating baths and the stabilizing processes therefor. Another object is to provide a process for the ready removal of undesired phosphite anion by-products and the prevention of their accumulation in such baths. Still another object is to provide a process which avoids the need to introduce an extraneous source of undesired cations such as sodium into such baths. A further object of this invention is to provide a continuous process for stabilizing electroless nickel baths. These and other objects of this invention will be apparent from the following further detailed description thereof.

The stabilizing process of this invention, utilized for electroless nickel baths employing a hypophosphite reducing agent and operated under electroless nickel conditions, comprises in its simplest embodiment adding lithium hydroxide to the bath during the electroless nickel reaction to form dilithium phosphite in the bath by the inter-reaction of the lithium from the lithium hydroxide and the phosphite anions produced as a result of the hypophosphite reducing agent being oxidized followed by subjecting the bath to insolubilizing conditions under which the dilithium phosphite becomes insoluble in the bath and then finally removing the insoluble lithium phosphite from the bath using appropriate separation procedures.

The electroless nickel plating baths stabilized according to this invention generally employ the conventional methods used in preparing and operating electroless nickel baths. In typical procedures an aqueous bath solution is prepared and charged to an appropriate electroless plating vessel- Such aqueous bath solution is usually prepared by adding the desired bath components including a hypophosphite reducing agent and a source of nickel cations for plating for example a nickel salt such as nickel sulfate. The pH and temperature of the bath are adjusted to the desired ranges followed by immersion of a suitable substrate within the bath so prepared upon which the nickel is to be plated or deposited. The substrate employed for such purpose may be a metal such as aluminum or mild steel or a non-metal such as a plastic which may according to established practice be first surface activated.

The pH of the bath is adjusted within the normal ranges employed for operating conventional acid or alkaline baths and generally within the range of from about 1 to 11. While the process may be employed for both acid or alkaline baths the preferred baths for stabilization according to this invention are usually acidic and usually with a pH within the range of from about 3 to about 7 and preferably for a preferred embodiment within the scope of this invention within from about 4 to about 5.

The pH control of the bath during the reaction according to a unique embodiment of this invention is readily achieved through employment of the lithium hydroxide which is added to form the desired separable dilithium phosphite. According to such preferred embodiment the lithium hydroxide is added to the bath in an amount sufficient to produce the desired pH range for operating the electroless nickel plating bath. The amount of lithium hydroxide added is appropriate to raise and maintain this desired pH range and at a minimum must be introduced in an amount stoichiometrically sufficient to react with the phosphite anion produced through oxidation of the hypophosphite reducing agent. The simultaneous use of the lithium hydroxide to control the bath pH while forming the phosphite also achieves a desired objective according to this invention of avoiding the addition of alkali metal cations such as sodium through the use of sodium hydroxide which is conventionally utilized to adjust the pH.

While the desired dilithium phosphite according to this invention may be formed from a variety of lithium sources such as lithium carbonate, the use of lithium as a hydroxide, however, is particularly preferred because it also may be readily employed to control the pH of the bath during the plating operation. The lithium hydroxide employed according to this invention is normally in the mono hydrate form and is advantageously used as an aqueous solution having a concentration of from about 0.1 to about 3 mols per liter.

The hypophosphite reducing agent employed in the baths stabilized according to this invention may be any of those conventionally used for electroless nickel plating such as sodium hypophosphite. However as a particularly preferred embodiment according to the present invention, the hypophosphite reducing agent employed in the reaction may be lithium hypophosphite which further serves to minimize the extraneous introduction of sodium cations into the reaction bath. The use of lithium hypophosphite further provides an additional source of lithium into the bath for facilitating the formation of the desired dilithium phosphite. The amount of the reducing agent employed in the plating bath is at least sufficient to stoichiometrically reduce the nickel cation in the electroless nickel reaction to free nickel metal and such concentration is usually within the range of from about 0.05 to about 1.0 mols per liter. As in conventional practice the reducing agent may be replenished during the reaction.

The sources of the nickel cations for the plating may include any of the water soluble or semi-soluble salts of nickel which are conventionally employed. Of these salts nickel chloride, nickel sulfamate or preferably nickel sulfate may be used. Usually the source of nickel is present to sufficiently provide a concentration of nickel cation at from about 0.02 to about 0.3 mols per liter.

The baths stabilized according to this invention may contain in addition to the sources of nickel and hypophosphite other conventional bath additives such as buffering, complexing, chelating agents or exaltants as well as stabilizers and brighteners.

The temperature employed for the plating bath is in part a function of the desired rate of plating as well as the composition of the bath. Typically the temperature is within the conventional ranges of from about 25° C. to atmospheric boiling at 100° C., although in a preferred embodiment according to this invention, is preferably below the temperature at which the dilithium phosphite precipitates in the particular plating solution usually below 90° C. and within the range of from about 30° to 90° C.

As the plating reaction proceeds the dilithium phosphite forms in the plating bath as a result of the interreaction between the lithium hydroxide and the phosphite anions. The plating bath according to the process of this invention is then subjected to insolubility conditions to form the insoluble dilithium phosphite which is capable of being readily removed from the plating bath solution. The insolubility conditions employed include temperature and in a preferred embodiment in combination with pH. Because the dilithium phosphite formed in the electroless nickel solution has the unique property and the characteristic of being inversely soluble with temperature, the condition of elevated temperature provides a simple and advantageous method of insolubilizing the dilithium phosphite for ready removal from the plating bath solution. The particular temperature selected for the insolubility conditions is dependent upon several factors including the particular bath components employed; continuous or batch operation; acid or alkaline bath operation and the pH used in operating the bath.

Because the dilithium phosphite is inversely soluble with temperature an advantageous feature of the present invention is to conduct the electroless nickel reaction at a temperature with in the range of from about 25° to atmospheric boiling at 100° C. within such range but at a temperature below the temperature at which the dilithium phosphite becomes insoluble in the particular electroless nickel plating solution being utilized for the plating operation. Accordingly a particularly effective method of applying the insolubility conditions of this invention is to simply raise the temperature of the plating bath solution above the plating operating temperature and at least above about 3° to 5° C. up to atmospheric boiling at 100° C. and generally to within the range of from about 90° to 100° C. The insolubility conditions of temperature according to this invention may be enhanced, and particularly for conventional acid baths, by simultaneously employing as the insolubility conditions, pH. This is readily achieved by increasing the pH of the plating solution to favor the formation of the insoluble dilithium phosphite. The pH for such insolubility conditions according to this invention may be raised about 0.2 to about 5 pH points above the operating pH used for the plating operation and generally to create a pH in the bath being subject to insolubility conditions according to a preferred embodiment of this invention to within a pH range of from about 5 about to about 10.

Uniquely the process of this invention may also be used to stabilize conventional alkaline or ammoniacal electroless nickel baths which typically operate within a pH range of from 8 to 11. In applying the stabilizing process of this invention to such alkaline baths the insolubility conditions applied do not necessarily include use of pH in combination with temperature and the temperature conditions as described above may be solely employed for the insolubility conditions of the alkaline bath to be stabilized.

In practicing the process of this invention the specific mode or procedure employed is dependent upon whether the stabilization is performed as a batch or, according to a preferred embodiment of this invention, as a continuous process. In general, however, when the conventional plating operation has been continued under appropriate electroless nickel plating conditions and according to this invention with the addition of lithium hydroxide to both control the desired operating pH and particularly the formation of dilithium phosphite, the plating is terminated by withdrawal of the substrate being plated. The point of termination or duration of the plating will depend upon several factors such as the quantity of nickel metal desired for the deposit, plating rate, temperature and bath composition. According to the present invention an appropriate controlling point for effecting such termination is the concentration of phosphite being generated and when, for example, the concentration exceeds above about 0.4 mols per liter of phosphite anion the plating operation may be terminated by withdrawal of the substrate being plated- The bath solution is then subjected to the insolubility conditions of this invention to form the separable dilithium phosphite.

After subjecting the bath to the insolubility conditions of temperature, and when required pH, the removal of the insoluble dilithium phosphite formed may be achieved using appropriate separational techniques such as decanting, centrifuging or filtration. Filtration, however, because of the ease of operation in a preferred procedure and may be performed by passing the plating solution through an appropriate filter medium having a pore size approximate to entrap the insolubilized dilithium phosphite. Filters having capture size in the range below about 5 microns are suitable for such purpose.

A particularly preferred and advantageous feature of the present invention permits the bath stabilization to be achieved on a continuous basis. In conducting a continuous process for stabilizing the electroless nickel plating bath of this invention, the plating bath containing the desired bath components is maintained in a suitable plating vessel or bath zone such as a glass or plastic tank. The plating is allowed to proceed upon a suitable substrate under electroless nickel plating conditions. According to this invention the desired bath pH and formation of dilithium phosphite is controlled by the addition of lithium hydroxide. A stream portion of the bath is then continuously withdrawn from the plating vessel and passed by appropriate pumping means to an insolubility zone such as a vessel or tank. The rate of withdrawal from the plating vessel may be controlled by monitoring the phosphite concentration buildup and the withdrawal rate increased or decreased to maintain the desired phosphite concentration generally below about 0.4 mols per liter. The stream portion of the bath is then subjected to the insolubility conditions of temperature and pH in the insolubility zone to form the insoluble dilithium phosphite. After an appropriate residence time in the insolubility zone vessel, the stream portion of the bath solution now containing the suspended insoluble lithium phosphite is passed from the insolubility zone such as by pumping means to a removal zone where the insoluble dilithium phosphite is separated from the bath solution. Such removal zone may appropriately be a filter of conventional design having the ability to separate particle sizes below about 0.5 microns on a continuous basis. The stream portion of the bath is then continuously returned to the bath zone from the removal zone to continuously stabilize the bath solution with replenished bath solution substantially free of phosphite anions.

The continuous process may be thus operated over long periods of time with the conventional replenishment of the sources of the nickel and hypophosphite plating materials to achieve a stabilized bath capable of long plating runs.

The following Examples are offered to illustrate the stabilized electroless nickel plating baths of this invention and the modes of carrying out such invention:

EXAMPLE 1

An electroless nickel plating bath was prepared in accordance with conventional procedures using stock solutions prepared for the bath components and utilizing deionized, carbon treated and filtered water and plating grade chemicals. The concentrations of batch components were analyzed by standard, spectrographic, emission and absorption techniques. The bath was formulated as follows:

| CONSTITUENT | CONCENTRATION, MOLES/LITER(M/L) |
|---|---|
| Nickel Sulfate | 0.102 |
| Lactic Acid | 0.306 |
| Acetic Acid | 0.30 |
| Lithium Hypophosphite | 0.306 |
| Lead | $3.86 \times 10^{-6}$ |

Steel panels were plated in a four liter bath of the above composition at a temperature of about 87° C. The bath was analyzed for nickel and hypophosphite content and such constituents were replenished as required according to normal practice. The phosphite anion concentration was also monitored during operation of the bath. The pH of the bath was maintained at about 4.6 through the addition of a 2.5 molar(M) solution of lithium hydroxide monohydrate. After approximately a metal turnover of 1.75 of the original nickel content, a solution of lithium hydroxide (2.5M) was added in an amount sufficient to raise the pH of the bath to 5.03 and the bath solution was heated to 93° C. whereupon relatively insoluble lithium phosphite formed. The bath solution was filtered through a 0.5 micron filter to remove insoluble dilithium phosphite and returned to the plating vessel. The plating was then resumed under the prior plating conditions. The rate of deposition of electroless nickel on the steel was measured at near the end of the original plating run at approximately 1.75 metal turnovers and at 85° C. and after the plating in the second run was resumed using the stabilized bath from which the insoluble dilithium phosphite had been substantially removed. The nickel cation and phosphite anion concentrations were measured both before and after the stabilizing removal of the dilithium phosphite with the following analysis results:

| ANALYSIS, 1.75 METAL TURNOVERS | BEFORE | AFTER |
|---|---|---|
| Nickel Ions, M/L | 0.103 | 0.100 |
| Phosphite Ions, M/L | 0.470 | 0.350 |
| Rate, Microns/Hour | 16.3 | 17.5 |

EXAMPLE 2

Following the procedure of Example 1 a bath was prepared with the following constituents:

| CONSTITUENT | CONCENTRATION, MOLES/LITER(M/L) |
|---|---|
| Nickel Sulfate | 0.102 |
| Glycine | 0.18 |
| Succinic Acid | 0.10 |
| Lithium Hypophosphite | 0.18 |
| Lead | $3.86 \times 10^{-6}$ |

The bath was operated at approximately 87° C. and with a pH of approximately 4.8 maintained by the addition of an appropriate amount of lithium hydroxide monohydrate as a 2.5M (molar) solution. The bath was stabilized as in Example 1 after approximately 3 metal turnovers by adding lithium hydroxide to raise the pH to about 5.1 followed by filtration using a 0.5 micron filter media to remove dilithium phosphite. Thereafter the stabilized plating solution was again used to continue plating. The plating rate was determined both before and after the stabilization removal of phosphite anions as well as the concentrations of nickel and phosphite with the following analysis results:

| ANALYSIS, 3.0 METAL TURNOVERS | BEFORE | AFTER |
|---|---|---|
| Nickel Ions, M/L | 0.0570 | 0.050 |
| Phosphite Ions, M/L | 0.481 | 0.360 |
| Rate, Microns/Hour | 15.4 | 17.0 |

EXAMPLE 3

Following the procedure of Example 1 a bath was prepared with the following constituents:

| CONSTITUENT | CONCENTRATION, MOLES/LITER(M/L) |
|---|---|
| Nickel Sulfate | 0.13 |
| Malic Acid | 0.26 |
| Propionic Acid | 0.05 |
| Lithium Hypophosphite | 0.39 |
| Lead | $3.86 \times 10^{-6}$ |

The bath was operated at approximately 87° C. and with a pH of approximately 4.6 maintained by the addition of a sufficient amount of lithium hydroxide monohydrate as a 2.5M (molar) solution. The bath was stabilized as in Example 1 after approximately 1,4 metal turnovers by adding lithium hydroxide to raise the pH to about 5.1 followed by filtration using a 0.5 micron filter to remove insoluble dilithium phosphite. Thereafter the stabilized plating solution was again used to continue plating. The plating rate was determined both before and after the stabilization removal of phosphite anions as well as the concentrations of nickel and phosphite with the following analysis results:

| ANALYSIS, 1.4 METAL TURNOVERS | BEFORE | AFTER |
|---|---|---|
| Nickel Ions, M/L | 0.128 | 0.121 |
| Phosphite Ions, M/L | 0.480 | 0.340 |
| Rate, Microns/Hours | 12.6 | 16.3 |

EXAMPLE 4

An electroless nickel plating bath is prepared for continuous operation by initially formulating such bath with the following constituents:

| CONSTITUENT | CONCENTRATION, MOLES/LITER(M/L) |
|---|---|
| Nickel Sulfate | 0.1 |
| Glycine | 0.4 |
| Malic Acid | 0.1 |
| Acetic Acid | 0.25 |
| Lithium Hypophosphite | 0.3 |
| Lead | $5.0 \times 10^{-6}$ |

The temperature in the plating vessel is maintained at about 87° C. and the pH of the bath is continuously adjusted to about 4.6 by adding lithium hydroxide monohydrate. As the phosphite concentration exceeds 0.4 mols per liter a portion of the bath solution is continuously withdrawn as a stream from the plating vessel and passed to a insolubility settling tank by a pump adjusted at the desired flow rate through a heat exchanger to raise the temperature of the bath solution to about 95° C. The pH of the bath solution is adjusted to a pH above 5.0 by adding a solution of lithium hydroxide monohydrate. The bath steam solution is them mixed in the insolubility tank for a residence period sufficient to precipitate the dilithium phosphite. The bath solution stream is then returned to the plating vessel after first passing through a 0.5 micron filter sufficient to remove the insoluble dilithium phosphite.

EXAMPLE 5

The continuous plating bath operation of Example 4 is used to conduct an alkaline electroless nickel plating operation. The bath is initially formulated with the following constituents:

| CONSTITUENT | CONCENTRATION, MOLES/LITER(M/L) |
|---|---|
| Nickel Sulfate | 0.102 |
| Potassium Pyrophosphate | 0.14 |
| Ammonium Hydroxide | 0.30 |
| Lithium Hypophosphite | 0.25 |
| 2,2 Thiodiethanol | $2.0 \times 10^{-4}$ |

The temperature is maintained in the plating vessel within the range of 40° C. to 75° C. and the pH of the bath is continuously adjusted to 9.0 by the addition of lithium hydroxide monohydrate. As the phosphite concentration exceeds 0.4 mols per liter a portion of the bath solution is continuously withdrawn as a stream from the plating vessel and passed to a insolubility settling tank by a pump adjusted at the desired flow rate through a heat exchanger to raise the temperature of bath solution to about 95° C. The bath solution steam is them mixed in the insolubility tank for a residence period sufficient to precipitate the dilithium phosphite. The bath stream is then returned to the plating vessel after first passing through a 0.2 to 0.5 micron filter to remove the insoluble dilithium phosphite.

I claim:

1. A process for stabilizing electroless nickel plating baths employing a hypophosphite reducing agent and conducted under electroless nickel plating conditions which comprises adding lithium hydroxide to said bath to form dilithium phosphite therein from the reaction of said hydroxide and the phosphite anion produced in the electroless reaction, subjecting the bath to insolubility conditions to form insoluble dilithium phosphite and thereafter removing the phosphite anion from the bath in the insoluble dilithium phosphite.

2. The process of claim 1 where in the lithium hydroxide is added to control the pH of the bath during the electroless plating in addition to forming the dilithium phosphite.

3. The process of claim 2 wherein the insolubility conditions include increasing the temperature of the bath above the temperature employed for conducting the electroless plating.

4. The process of claim 3 wherein the temperature is increased above the electroless plating temperature by at least from about 3° to about 5° C. above the plating temperature.

5. The process of claim 2 wherein the temperature is increased above the electroless plating temperature to within the range of from about 90° to 100° C.

6. The process of claim 2 wherein the insolubility conditions include in combination with increasing the temperature also raising the pH above the pH employed for conducting the electroless plating.

7. The process of claim 6 wherein the pH is increased above the pH for conducting the electroless plating to within the range of from about 5 to about 10.

8. The process of claim 1 wherein the hypophosphite reducing agent employed in the electroless nickel plating is lithium hypophosphite.

9. The process of claim 2 wherein the electroless nickel plating conditions include operating the bath under acidic pH of from about 3 to about 7.

10. The process of claim 1 wherein the bath is subject to the insolubility conditions when the phosphite anion concentration in the bath exceeds above about 0.4 mols per liter.

11. A stabilized electroless nickel plating bath employing a hypophosphite reducing agent and operated under electroless nickel plating reaction conditions which has been treated to remove and control the phosphite anion produced in the electroless reaction by adding lithium hydroxide to the bath to form dilithium phosphite which upon application of insolubility conditions becomes insoluble in the bath and in such insoluble form is recovered from the bath to remove the phosphite anion contained in the dilithium phosphite.

12. The electroless nickel plating bath according to claim 11 wherein the lithium hydroxide is added to control the pH of the bath during the electroless plating in addition to forming the dilithium phosphite.

13. The electroless nickel plating bath according to claim 11 wherein the insolubility conditions include increasing the temperature of the bath above the temperature employed for conducting the electroless plating.

14. The electroless nickel plating bath according to claim 13 wherein the temperature is increased above the electroless plating temperature by at least from about 3° to about 5° C. above the plating temperature.

15. The electroless nickel plating bath according to claim 14 wherein the temperature is increased above the electroless plating temperature to within the range of from about 90° to 100° C.

16. The electroless nickel plating bath according to claim 13 wherein the insolubility conditions include in combination with increasing the temperature also raising the pH above the pH employed for conducting the electroless plating.

17. The electroless nickel plating bath according to claim 16 wherein the pH is increased above the pH for conducting the electroless plating to within the range of from about 5 to about 10.

18. The electroless nickel plating bath according to claim 16 wherein the electroless nickel plating conditions include operating the bath under acidic pH of from about 3 to about 5.

19. The electroless nickel plating bath according to claim 13 wherein the bath is subject to the insolubility conditions when the phosphite anion concentration in the bath exceeds above about 0.4 mols per liter.

20. A continuous process for stabilizing electroless nickel plating baths employing a hypophosphite reducing agent conducted under electroless reaction conditions which comprises adding lithium hydroxide to such bath maintained in a bath zone in an amount sufficient to form lithium phosphite, withdrawing a stream portion of the bath from the bath zone, passing such stream portion to an insolubility zone and subjecting such stream to insolubility conditions therein for forming insoluble dilithium phosphite in such zone, passing such stream portion containing suspended insoluble dilithium phosphite to a removal zone, separating the suspended dilithium phosphite from the stream portion in such zone and continuously returning the stream portion to the bath zone substantially free of phosphite anions.

* * * * *